US008070698B2

(12) United States Patent
Wu et al.

(10) Patent No.: US 8,070,698 B2
(45) Date of Patent: Dec. 6, 2011

(54) MASSAGE DEVICE WITH A SHAFT TRANSMISSION MECHANISM

(75) Inventors: Chichun Wu, Dongguan (CN); Zhao Zhang, Dongguan (CN); Chi-Wu Chiang, Dongguan (CN)

(73) Assignee: Weightec Electronic Technology Co., Ltd., Dongguan, Guangdong Province (CN)

( * ) Notice: Subject to any disclaimer, the term of this patent is extended or adjusted under 35 U.S.C. 154(b) by 834 days.

(21) Appl. No.: 12/145,290

(22) Filed: Jun. 24, 2008

(65) Prior Publication Data

US 2009/0270777 A1 Oct. 29, 2009

Related U.S. Application Data

(63) Continuation-in-part of application No. 12/103,785, filed on Apr. 16, 2008.

(60) Provisional application No. 61/048,688, filed on Apr. 29, 2008.

(51) Int. Cl.
*A61H 15/00* (2006.01)

(52) U.S. Cl. ..... 601/87; 601/84; 601/101

(58) Field of Classification Search ..... 601/84, 601/87, 100–103, 112, 113, 116
See application file for complete search history.

(56) References Cited

U.S. PATENT DOCUMENTS 5,265,590 A 11/1993 Takagi
5,460,598 A 10/1995 Yamasaki et al.
6,454,731 B1 9/2002 Marcantoni
D491,375 S 6/2004 Yuyama
6,808,500 B1 10/2004 Cheng-Yi et al.
6,849,054 B1 2/2005 Kim
6,890,313 B2 5/2005 Kim
6,916,300 B2 7/2005 Hester et al.
D517,337 S 3/2006 Mori
7,014,620 B2 3/2006 Kim
7,018,347 B2 3/2006 Kim
7,037,279 B2 5/2006 Kim
7,048,701 B2 5/2006 Kim
7,052,475 B2 5/2006 Kim
7,052,476 B2 5/2006 Kim
7,081,098 B2 7/2006 Kim
7,081,099 B1 7/2006 Luo
7,081,100 B2 7/2006 Kim
7,108,669 B2 9/2006 Huang
7,108,670 B2 9/2006 Huang
7,118,541 B2 10/2006 Kim
7,120,947 B1 10/2006 Magallanes
7,125,389 B2 10/2006 Sin
7,128,721 B2 10/2006 Ferber et al.
D531,424 S 11/2006 Kusachi
7,160,261 B1 1/2007 Huang
7,179,240 B2 2/2007 Wu
7,207,957 B2 4/2007 Szczepanski
7,264,598 B2 9/2007 Shin
7,347,833 B2 3/2008 Kim
(Continued)

*Primary Examiner* — Michael A. Brown
(74) *Attorney, Agent, or Firm* — Morris Manning & Martin LLP; Tim Tingkang Xia, Esq.

(57) ABSTRACT

The present invention relates to a massage device. In one embodiment, the massage device includes a massage assembly and a transmission assembly having a threaded bolt transmission mechanism for driving the massage assembly to provide massage effects. The massage assembly includes a pair of massage members. Each massage member has a driving member having an eccentric wheel and an eccentric block, a massage bracket engaged with the driving member and a plurality of massage heads attached to the massage bracket.

19 Claims, 6 Drawing Sheets

U.S. PATENT DOCUMENTS

| | | | | |
|---|---|---|---|---|
| D565,855 | S | 4/2008 | Takahashi et al. | |
| 7,947,002 | B2 * | 5/2011 | Mizoguchi et al. | 601/99 |
| 2004/0243034 | A1 | 12/2004 | Kim | |
| 2005/0049530 | A1 | 3/2005 | Kim | |
| 2005/0049531 | A1 | 3/2005 | Kim | |
| 2005/0101890 | A1 * | 5/2005 | Mizoguchi et al. | 601/84 |
| 2007/0149906 | A1 * | 6/2007 | Mizoguchi et al. | 601/84 |
| 2007/0208284 | A1 | 9/2007 | Huang | |
| 2008/0048475 | A1 | 2/2008 | Tanizawa et al. | |
| 2008/0051683 | A1 | 2/2008 | Tanizawa | |
| 2009/0227915 | A1 * | 9/2009 | Chiang | 601/115 |
| 2009/0270778 | A1 * | 10/2009 | Wu et al. | 601/97 |

* cited by examiner

MASSAGE DEVICE WITH A SHAFT TRANSMISSION MECHANISM

CROSS-REFERENCE TO RELATED PATENT APPLICATION

This application is a continuation-in-part of U.S. patent application Ser. No. 12/103,785, filed Apr. 16, 2008, entitled "A Massage Device," by Chi-Wu Chiang, the disclosure for which is incorporated herein by reference in its entirety, which itself claims priority to and the benefit of, pursuant to 35 U.S.C. §119(a), Chinese patent application Serial No. 200820091616.4, filed Mar. 7, 2008, entitled "A Massage Device," by Chi-Wu Chiang, which is incorporated herein by reference in its entirety. This application also claims priority to and the benefit of, pursuant to 35 U.S.C. §119(e), of provisional U.S. patent application Ser. No. 61/048,688, filed Apr. 29, 2008, entitled "Massage Device With a Hoist Transmission Mechanism," by Chichun Wu and Zhao Zhang, which is incorporated herein by reference in its entirety.

FIELD OF THE INVENTION

The present invention relates generally to a massage device, and more particularly to a massage device that utilizes a shaft transmission mechanism and a gyro mechanism to provide massaging effects.

BACKGROUND OF THE INVENTION

Simulated massaging or kneading of parts of the body to aid circulation or relax the muscles has gained popularity, particularly, among people who are lack of exercise. The simulated massaging or kneading effects can be achieved electromagnetically and/or mechanically by means of a massage device. For the electromagnetic massaging or kneading, such a massage device is configured to generate a series of electromagnetic pulses, which are regularly directed to parts of interest of the body so as to perform massaging or kneading thereon. However, the massaging or kneading area of the massage device is limited, and the massaging or kneading effects may not be very gentle.

For the mechanical massaging or kneading, the massage device is usually designed to have a plurality of massage nodes and a driving system to drive the plurality of massage nodes to rotate so as to simulate massaging or kneading when applied to parts of interest of the body. Comparing to the electromagnetic massaging, the limitation of the massaging or kneading area is improved for the mechanical massaging. However, mechanical massage devices are relatively complex and costly.

Therefore, a heretofore unaddressed need exists in the art to address the aforementioned deficiencies and inadequacies.

SUMMARY OF THE INVENTION

The present invention, in one aspect, relates to a massage device. In one embodiment, the massage device has a base cover, a rack, a carriage, a transmission assembly and a massage assembly.

The base cover has a longitudinal axis and a plurality of guiding rails formed parallel to the longitudinal axis. The rack is formed in the base cover and paralleled to the plurality of guiding rails.

The carriage has a chassis member and a shield member placed over the chassis member to form a chamber therebetween. The chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

The transmission assembly is received in the chamber and secured in the carriage. The transmission assembly has a motor having an output shaft, a worm mechanically coupled with the output shaft of the motor, a worm wheel meshing with the worm, and a transmission shaft having a first end portion, an opposite, second end portion, a shaft body defined therebetween, and an axis. The shaft body has a cross-sectional shape of a polygon. The transmission shaft is mechanically coupled with the worm wheel by the first end portion.

Furthermore, the transmission assembly includes a first lead gear having an exterior surface defining a gear, and an interior surface defining a polygon bore. The polygon bore is adapted for receiving the transmission shaft such that when the polygon bore of the first lead gear receives the transmission shaft, the first lead gear is slidably movable back and forth along the transmission shaft, while not rotatable relative to the transmission shaft around the axis of the transmission shaft.

Moreover, the transmission assembly includes a pair of pinion gears meshing with the first lead gear, and a second lead gear, having a first gear portion meshing with one of the pair of pinion gears, a second gear portion meshing with the other of the pair of pinion gears, and a third gear portion formed therebetween, the third gear portion meshing with the rack.

Additionally, the transmission assembly includes a first bevel gear having an exterior surface, an interior surface defining a polygon bore, and a conically gear formed on the exterior surface, wherein the polygon bore is adapted for receiving the transmission shaft such that when the polygon bore of the first bevel gear receives the transmission shaft, the first bevel gear is slidably movable back and forth along the transmission shaft, while not rotatable relative to the transmission shaft around the axis of the transmission shaft.

The transmission assembly also includes a second bevel gear having a conical gear meshing with the conical gear of the first bevel gear and a cylindrical gear extending from the conical gear, a pair of first gears meshing with the cylindrical gear of the second bevel gear, and a pair of second gears, each meshing with a corresponding one of the pair of first gears, wherein the pair of second gears is engaged with the massage assembly.

For such an arrangement, when the motor is activated, it drives the worm to rotate, the rotation of the worm results in, in turn, the rotations of the worm wheels, the transmission shaft, the first lead gear, the first bevel gear, the second bevel gear, the pair of first gears and the pair of second gears, wherein the rotation of the first lead gear results in, in turn, the rotation of the pair of pinion gears, and the second lead gear, thereby moving the carriage along the plurality of the guiding rails of the base cover.

In one embodiment, the massage assembly has a pair of massage members. Each massage member includes a driving member, a massage bracket and a plurality of massage heads. Each of the plurality of massage heads has a mushroom-shape. In one embodiment, each of the plurality of massage heads has a first structure, a mushroom-shape node and a second structure placed between the first structure and the mushroom-shape node.

Additionally, each of the plurality of massage heads comprises an energy source of capable of generating at least one of thermal energy and photonic energy, where the source energy comprises a lamp base mounted to the corresponding one of the plurality of stumps, a PCB board attached to the lamp base, and heating lamps attached onto the PCB board.

In one embodiment, the driving member includes an eccentric wheel and an eccentric block. The eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion. The first cylindrical portion has a central axis substantially perpendicular to the first planar surface, and a diameter, $d_1$. The second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion. The shaft bore has a central axis that is substantially coincident with the central axis of the first cylindrical portion.

The eccentric block has a first planar surface and a second planar surface defining a cylinder body therebetween. The cylinder body has a central axis and a diameter, $d_3$, greater than the diameter $d_2$ of the second cylindrical portion of the eccentric wheel, and the first planar surface is tilted to the second planar surface at an angle $\gamma$.

Each of the angles $\alpha$, $\beta$ and $\gamma$ is greater than zero but less than 90°, preferably, greater than zero but less than 45°. In one embodiment, $\beta=\alpha$, and $\gamma=\alpha$.

The massage bracket includes a first surface and an opposite, second surface defining a bracket body therebetween, a central axis and a plurality of stumps spaced-apart on the first surface, wherein the bracket body defines a first opening in the central region.

As assembled, the plurality of massage heads is attached to the plurality of stumps of the massage bracket, respectively. The second cylindrical portion of the eccentric wheel is received in the first opening of the massage bracket. The eccentric block is mounted to the second cylindrical portion of the eccentric wheel. Accordingly, the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel and the central axis of the massage bracket is substantially coincident with the central axis of the second cylinder portion of the eccentric wheel, and the massage bracket operably cooperates with the second cylindrical portion of the eccentric wheel.

In one embodiment, each massage member further includes a gear shaft having a first end portion and an opposite, second end portion. The gear shaft extends through the shield member of the carriage and is coaxially mounted to the corresponding second gear of the transmission assembly by the first end portion, while received in the shaft bore of the eccentric wheel by the second end portion.

Each massage member may also include means for limiting the massage bracket from rotating along the central axis of the first cylindrical portion of the eccentric wheel, where the limiting means comprises a U-shape fixture or a fixture bar mounted to the shield member of the carriage.

For a massage device under such arrangement, in operation, the motor drives the pair of the transmission shaft to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user.

In another aspect, the present invention relates to massage device includes a transmission assembly. In one embodiment, the transmission assembly includes:

(a) a motor having an output shaft;

(b) a worm mechanically coupled with the output shaft of the motor;

(c) a worm wheel meshing with the worm;

(d) a transmission shaft having a first end portion, an opposite, second end portion, a shaft body defined therebetween, and an axis, wherein the shaft body has a cross-sectional shape of a polygon, and wherein the transmission shaft is mechanically coupled with the worm wheel by the first end portion;

(e) a first lead gear having an exterior surface defining a gear, and an interior surface defining a polygon bore, wherein the polygon bore is adapted for receiving the transmission shaft such that when the polygon bore of the first lead gear receives the transmission shaft, the first lead gear is slidably movable back and forth along the transmission shaft, while not rotatable relative to the transmission shaft around the axis of the transmission shaft;

(f) a pair of pinion gears meshing with the first lead gear;

(g) a second lead gear, having a first gear portion meshing with one of the pair of pinion gears, a second gear portion meshing with the other of the pair of pinion gears, and a third gear portion formed therebetween;

(h) a first bevel gear having an exterior surface, an interior surface defining a polygon bore, and a conically gear formed on the exterior surface, wherein the polygon bore is adapted for receiving the transmission shaft such that when the polygon bore of the first bevel gear receives the transmission shaft, the first bevel gear is slidably movable back and forth along the transmission shaft, while not rotatable relative to the transmission shaft around the axis of the transmission shaft;

(i) a second bevel gear having a conical gear meshing with the conical gear of the first bevel gear and a cylindrical gear extending from the conical gear;

(j) a pair of first gears meshing with the cylindrical gear of the second bevel gear; and (k) a pair of second gears, each meshing with a corresponding one of the pair of first gears, wherein the pair of second gears is engaged with the massage assembly, Under this arrangement, when the motor is activated, it drives the worm to rotate, the rotation of the worm results in, in turn, the rotations of the worm wheels, the transmission shaft, the first lead gear, the first bevel gear, the second bevel gear, the pair of first gears and the pair of second gears, wherein the rotation of the first lead gear results in, in turn, the rotation of the pair of pinion gears, and the second lead gear.

The massage device also includes a massage assembly having a plurality of massage heads, engaged with the transmission assembly such that the rotation of the pair of second gears drives the plurality of massage heads to move in a predefined way so as to provide massage effects, while the translation of the leadscrew along the transmission shaft drives the massage assembly to move along a the axis of the transmission shaft.

Additionally, the massage device may include a base cover having a longitudinal axis and a plurality of guiding rails formed parallel to the longitudinal axis, and a carriage for receiving and securing the transmission assembly therein, having a chassis member and a shield member placed over the chassis member to form a chamber therebetween. The chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

In one embodiment, the massage assembly has a pair of massage members. Each massage member includes a driving member having an eccentric wheel and an eccentric block. The eccentric wheel has a first planar surface, a second planar surface tilted to the first planar surface at an angle β, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, d1, wherein the second cylindrical portion has a central axis substantially perpendicular to the second planar surface and defining an angle α relative to the central axis of the first cylindrical portion, and a diameter, d2, less than the diameter d1 of the first cylindrical portion, and wherein the shaft bore has a central axis that is substantially coincident with the central axis of the first cylindrical portion.

The eccentric block has a first planar surface and a second planar surface defining a cylinder body therebetween, wherein the cylinder body has a central axis and a diameter, d3, greater than the diameter d2 of the second cylindrical portion of the eccentric wheel, and the first planar surface is tilted to the second planar surface at an angle γ.

Each massage member includes also has a massage bracket having a first surface and an opposite, second surface defining a bracket body therebetween, a central axis and a plurality of stumps spaced-apart on the first surface, wherein the bracket body defines an opening therethrough in the central region, As assembled, the plurality of massage heads is attached to the plurality of stumps of the massage bracket, respectively, the second cylindrical portion of the eccentric wheel is received in the opening of the massage bracket; the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel.

Additionally, each massage member may further have a gear shaft having a first end portion and an opposite, second end portion. The gear shaft extends through the shield member of the carriage and is coaxially mounted to the corresponding second gear of the transmission assembly by the first end portion, while received in the shaft bore of the eccentric wheel by the second end portion.

In one embodiment, each massage member also has means for limiting the massage bracket from rotating along the central axis of the first cylindrical portion of the eccentric wheel, where the limiting means comprises a U-shape fixture or a fixture bar mounted to the shield member of the carriage.

For such a massage device, in operation, the motor drives the pair of the transmission shaft to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle α, thereby causing the plurality of massage heads to move alternatively along a direction parallel to the central axis of the first cylindrical portion of the eccentric wheel so as to provide a massage effect to a user.

In another aspect, the present invention relates to a transmission assembly usable for a massage device. In one embodiment, the transmission assembly has a motor having an output shaft, a worm mechanically coupled with the output shaft of the motor, a worm wheel meshing with the worm, and a transmission shaft having a first end portion, an opposite, second end portion, a shaft body defined therebetween, and an axis. The shaft body has a cross-sectional shape of a polygon. The transmission shaft is mechanically coupled with the worm wheel by the first end portion.

Furthermore, the transmission assembly includes a first lead gear having an exterior surface defining a gear, and an interior surface defining a polygon bore. The polygon bore is adapted for receiving the transmission shaft such that when the polygon bore of the first lead gear receives the transmission shaft, the first lead gear is slidably movable back and forth along the transmission shaft, while not rotatable relative to the transmission shaft around the axis of the transmission shaft.

Moreover, the transmission assembly includes a pair of pinion gears meshing with the first lead gear, and a second lead gear, having a first gear portion meshing with one of the pair of pinion gears, a second gear portion meshing with the other of the pair of pinion gears, and a third gear portion formed therebetween, the third gear portion meshing with the rack.

Additionally, the transmission assembly includes a first bevel gear having an exterior surface, an interior surface defining a polygon bore, and a conically gear formed on the exterior surface, wherein the polygon bore is adapted for receiving the transmission shaft such that when the polygon bore of the first bevel gear receives the transmission shaft, the first bevel gear is slidably movable back and forth along the transmission shaft, while not rotatable relative to the transmission shaft around the axis of the transmission shaft.

The transmission assembly also includes a second bevel gear having a conical gear meshing with the conical gear of the first bevel gear and a cylindrical gear extending from the conical gear, a pair of first gears meshing with the cylindrical gear of the second bevel gear, and a pair of second gears, each meshing with a corresponding one of the pair of first gears, wherein the pair of second gears is engaged with the massage assembly.

For such an arrangement, when the motor is activated, it drives the worm to rotate, the rotation of the worm results in, in turn, the rotations of the worm wheels, the transmission shaft, the first lead gear, the first bevel gear, the second bevel gear, the pair of first gears and the pair of second gears, wherein the rotation of the first lead gear results in, in turn, the rotation of the pair of pinion gears, and the second lead gear.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
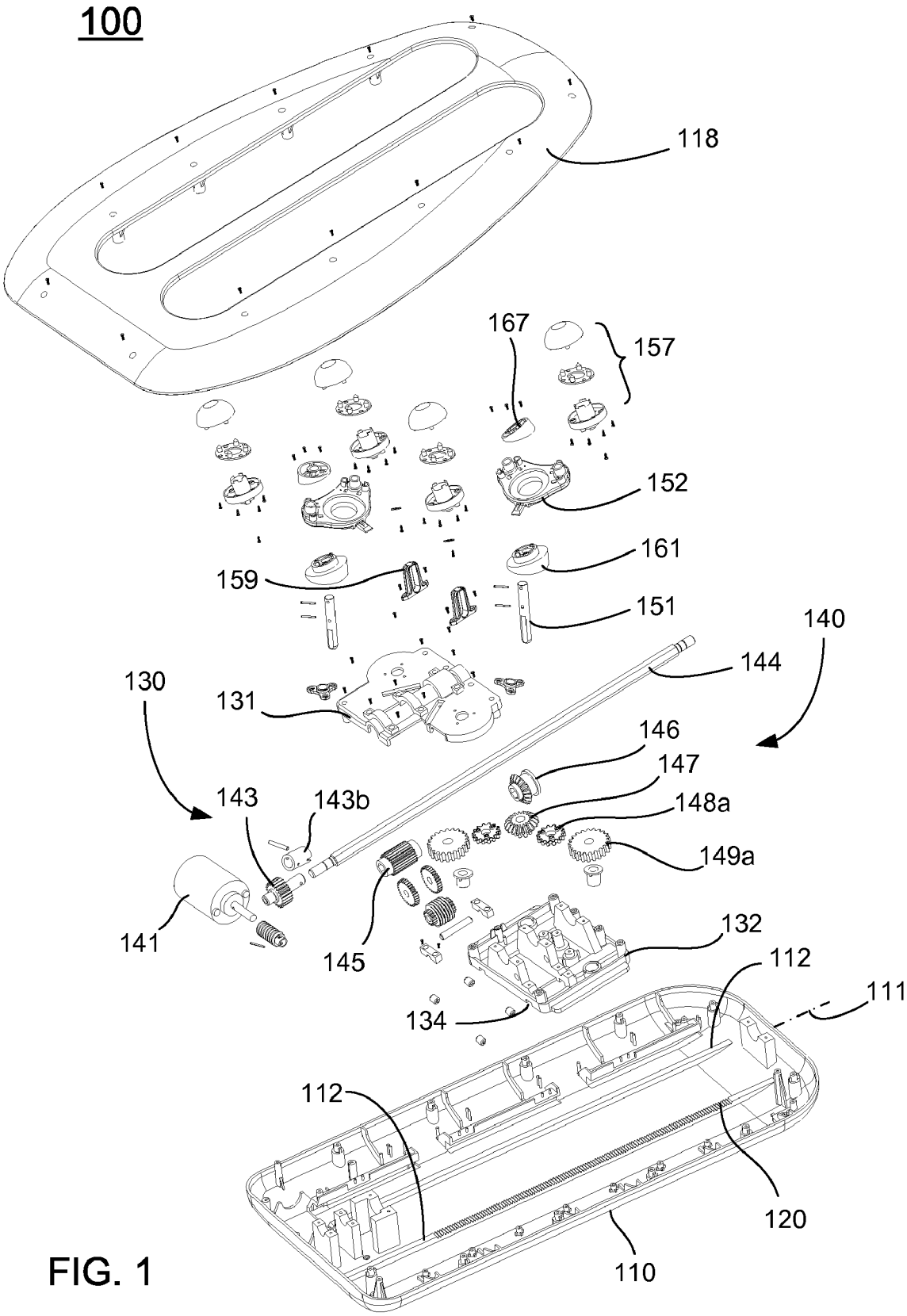
FIG. 1 shows an exploded view of a massage device according to one embodiment of the present invention.
Figure 2:
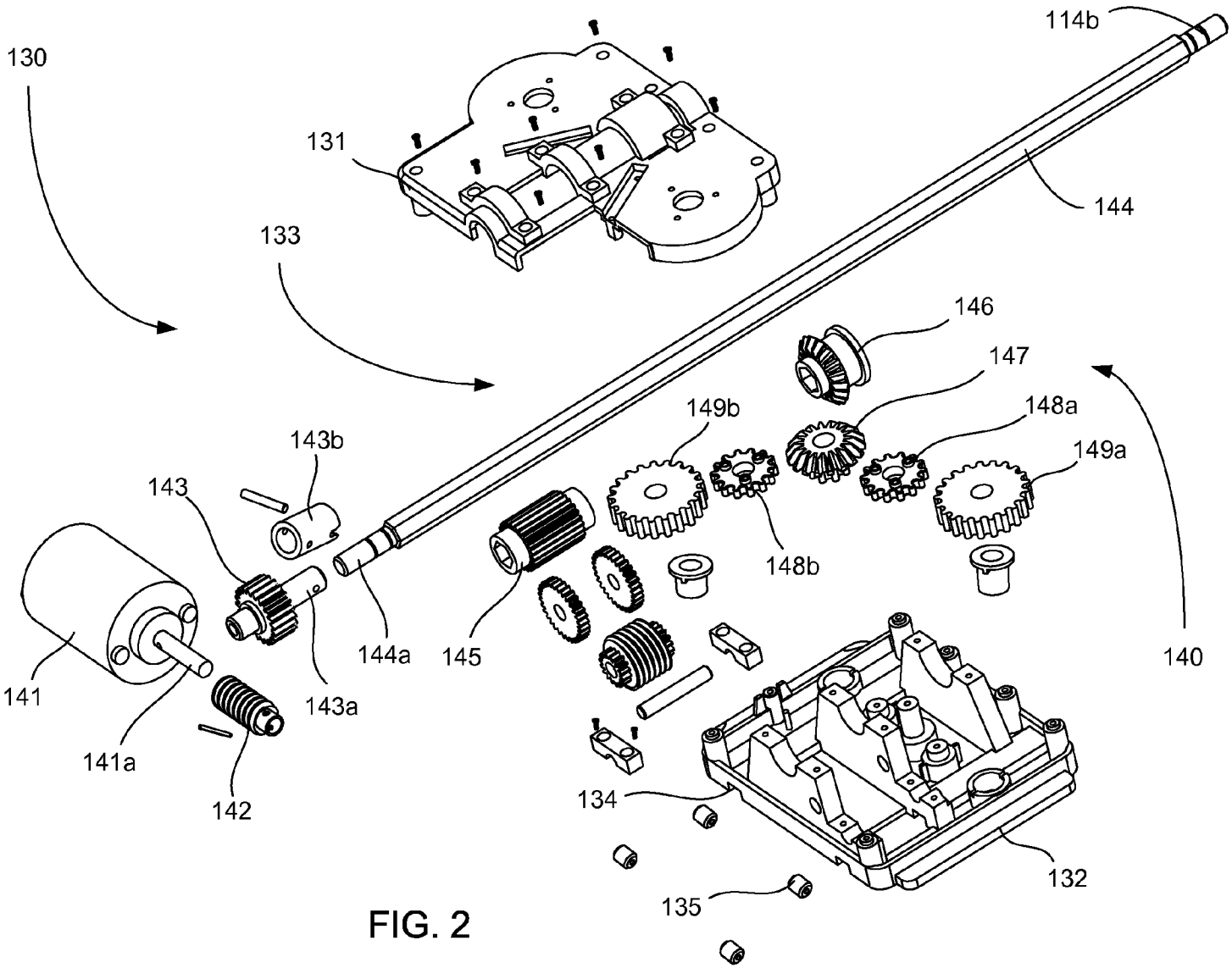
FIG. 2 shows a partially exploded view of the massage device as shown in FIG. 1.
Figure 3:
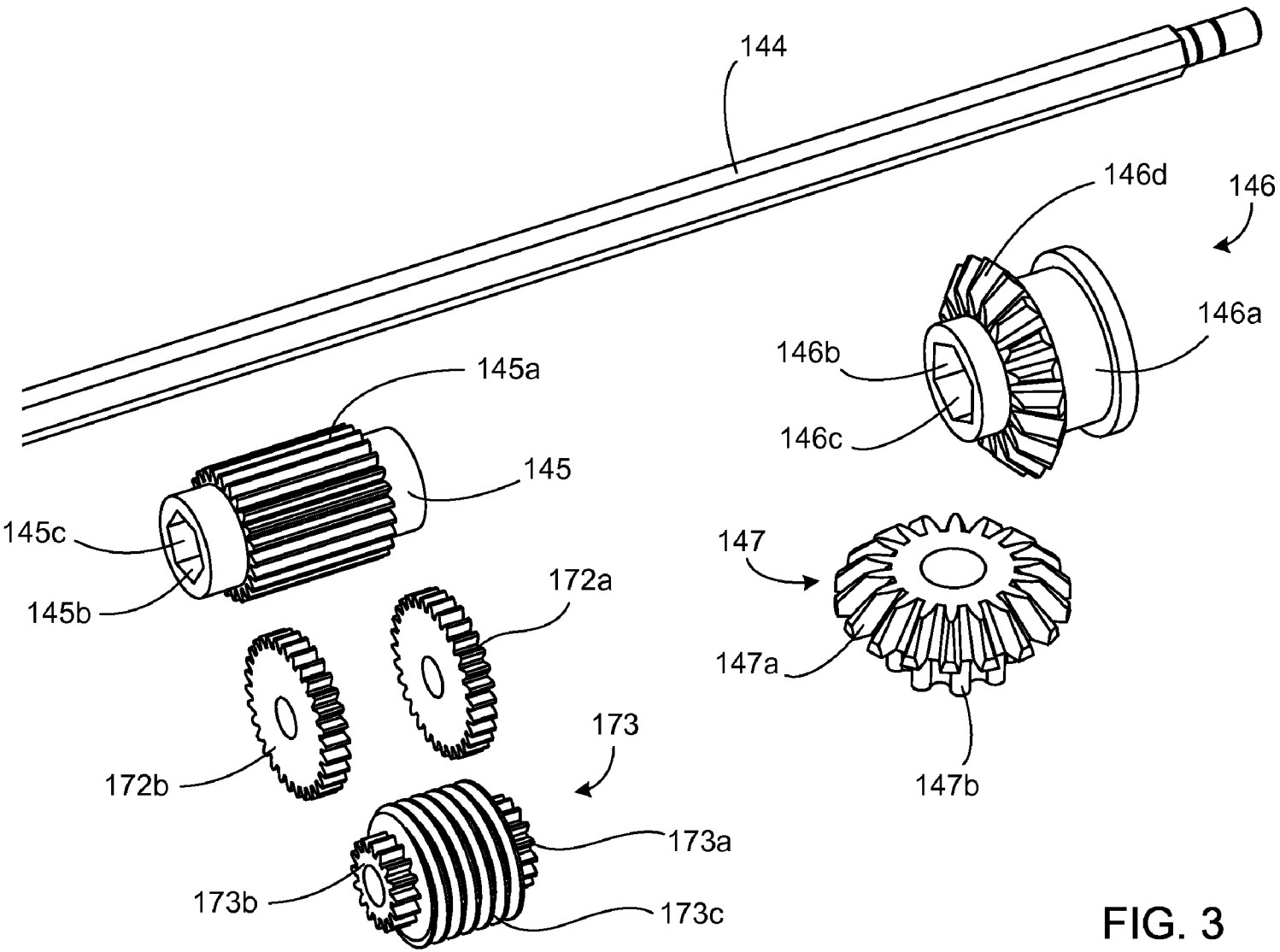
FIG. 3 shows a partially exploded view of a transmission assembly utilized in the massage device as shown in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The description will be made as to the embodiments of the present invention in conjunction with the accompanying drawings in FIGS. 1-6. In accordance with the purposes of this invention, as embodied and broadly described herein, this invention, in one aspect, relates to a massage device that utilizes a gyro mechanism and a threaded bolt transmission mechanism to provide massaging effects.

Referring first to FIGS. 1-5, a massage device 100 is shown according to one embodiment of the present invention. The massage device 100 includes a base cover 110, a rack 120, a carriage 130, a transmission assembly 140 and a massage assembly having a pair of massage members 150.

The base cover 110 has a longitudinal axis 111 and two guiding rails 112 formed parallel to the longitudinal axis 111. The two guiding rails 112 are adapted for cooperating with the carriage 130 and translating the pair of massage members 150 along the longitudinal axis 111. Other numbers of guiding rails can also be utilized to practice the present invention. The rack 120 is formed in the base cover 110 parallel to the longitudinal axis 111. In this embodiment as shown in FIG. 1, the rack 120 is coincident with one guiding rails 112.

The base cover 110 may also have a series of ribs 113 and supporting structures 114 for supporting and securing a top cover 118 to form a housing for accommodating the carriage 130, the transmission assembly 140 and the massage assembly therein. The base cover 110 is made of a durable material, such as wood, plastic, alloy or the like.

The carriage 130 includes a chassis member 131 and a shield member 132 placed over the chassis member 131 to form a chamber 133 therebetween. The chassis member 131 has two grooves 134 spaced-apart and formed on the bottom surface of the chassis member 131. The two grooves 134 are configured and sized to receive the two guiding rails 112 of the base cover 110, respectively. The cooperation of the guiding rails 112 of the base cover 110 and the grooves 134 of the chassis member 131 provides longitudinal guidance and support to the carriage 130 as it translates along the guiding rails 112. That is, when the carriage 130 is engaged with the base cover 110, the guiding rails 112 are respectively received in the grooves 134 of the chassis member 131 and the carriage 130 is longitudinally movable back and forth along the plurality of guiding rails 112 of the base cover 110. Other numbers of grooves can also be utilized to practice the present invention. The number of grooves is corresponding to the number of guiding rails formed in the base cover 110. Additionally, the carriage 130 may also include a plurality of roller bearings 135, which are each pivotally connected to the carriage 130 and are offset from the grooves 134 and adjacent thereto for engaging a bearing surface provide upon each guiding rail 112. As the carriage 130 translates along the guiding rail 112, the carriage 130 is bearingly supported by the roller bearings 135 as they engage the surfaces provided by the guiding rails 112.

The transmission assembly 140 is received in the chamber 133 and secured in the carriage 130. The transmission assembly 140 has a motor 141 having an output shaft 141*a*, a worm 142 mechanically coupled with the output shaft 141*a* of the motor 141, a worm wheel 143 meshing with the worm 142, and a transmission shaft 144 having a first end portion 144*a*, an opposite, second end portion 144*b*, a shaft body 144*c* defined therebetween, and an axis 144*e*. The shaft body 144*c* has a cross-sectional shape of a polygon. The transmission shaft 144 is mechanically coupled with the worm wheel 143 by the first end portion 144*a*. For example, the worm wheel 143 has a central shaft 143*a* that is engaged with the first end portion 144*a* of the transmission shaft 144 through a engaging means 143*b*.

Furthermore, the transmission assembly 140 includes a first lead gear 145 having an exterior surface 145*a* defining a gear, and an interior surface 145*b* defining a polygon bore 145*c*. The polygon bore 145*c* is adapted for receiving the transmission shaft 144 such that when the polygon bore 145*c* of the first lead gear 145 receives the transmission shaft 144, the first lead gear 145 is slidably movable back and forth along the transmission shaft 144, while not rotatable relative to the transmission shaft 144 around the axis 144*e* of the transmission shaft 144.

Moreover, the transmission assembly 140 includes a pair of pinion gears 172*a* and 172*b* meshing with the first lead gear 145, and a second lead gear 173, having a first gear portion 173*a* meshing with one of the pair of pinion gears 172*a* or 172*b*, a second gear portion 173*b* meshing with the other of the pair of pinion gears 172*a* or 172*b*, and a third gear portion 173*c* formed therebetween, the third gear portion 173*c* meshing with the rack 120.

Additionally, the transmission assembly 140 includes a first bevel gear 146 having an exterior surface 146*a*, an interior surface 146*b* defining a polygon bore 146*c*, and a conically gear 146*d* formed on the exterior surface 146*a*, wherein the polygon bore 146*c* is adapted for receiving the transmission shaft 144 such that when the polygon bore 146*c* of the first bevel gear 146 receives the transmission shaft 144, the first bevel gear 146 is slidably movable back and forth along the transmission shaft 144, while not rotatable relative to the transmission shaft 144 around the axis 144*e* of the transmission shaft 144.

The transmission assembly 140 also includes a second bevel gear 147 having a conical gear 147*a* meshing with the conical gear 146*d* of the first bevel gear 146 and a cylindrical gear 147*b* extending from the conical gear 147*a*, a pair of first gears 148*a* and 148*b* meshing with the cylindrical gear 147*b* of the second bevel gear 147, and a pair of second gears 149*a* and 149*b*, each meshing with a corresponding one of the pair of first gears 148*a* and 148*b*, wherein the pair of second gears 149*a* and 149*b* is engaged with the massage assembly.

For such an arrangement, when the motor 141 is activated, it drives the worm 142 to rotate, the rotation of the worm 142 results in, in turn, the rotations of the worm wheels 143, the transmission shaft 144, the first lead gear 145, the first bevel gear 146, the second bevel gear 147, the pair of first gears 148*a* and 148*b* and the pair of second gears 149*a* and 149*b*, wherein the rotation of the first lead gear 145 results in, in turn, the rotation of the pair of pinion gears 172*a* and 172*b*, and the second lead gear 173, thereby moving the carriage 130 along the plurality of the guiding rails of the base cover 110.

The massage assembly has a pair of massage members 150. Each massage member 150 has a gear shaft 151, a driving member 160, a massage bracket 152, two massage heads 157, and a limiting means such as a U-shape fixture or a fixture bar mounted to the shield member 132 of the carriage 130.

The gear shaft 151 has a first end portion 151*a* and an opposite, second end portion 151*b*. The gear shaft 151 extends through the shield member 132 of the carriage 130 and is coaxially mounted to the corresponding second gear 149*a* or 149*b* of the transmission shaft 140 by the first end portion 151*a*. In other words, when the second gear 149*a* or 149*b* rotate, it drives the corresponding gear shaft 151 to rotate accordingly.

The massage bracket 152 includes a first surface 152*a* and an opposite, second surface 152*b* defining a bracket body 152*c* therebetween, a central axis 152*d*, a protrusion 155 laterally extending from the bracket body 152*c*, and two stumps 153 spaced-apart on the first surface 152*b*. The protrusion structure 155 is utilized, together with a limiting means such as a U-shape fixture mounted to the shield member 132 of the carriage 130, to limit the motion of the massage heads 157 in a predetermined way so as to provide desired massage effects. The bracket body 152*c* defines an opening 154 therethrough in the central region. Two massage heads 157 are respectively attached to two stumps 153 of the massage bracket 152. Other numbers of massage heads and stumps can also be utilized to practice the present invention.

Figure 4:
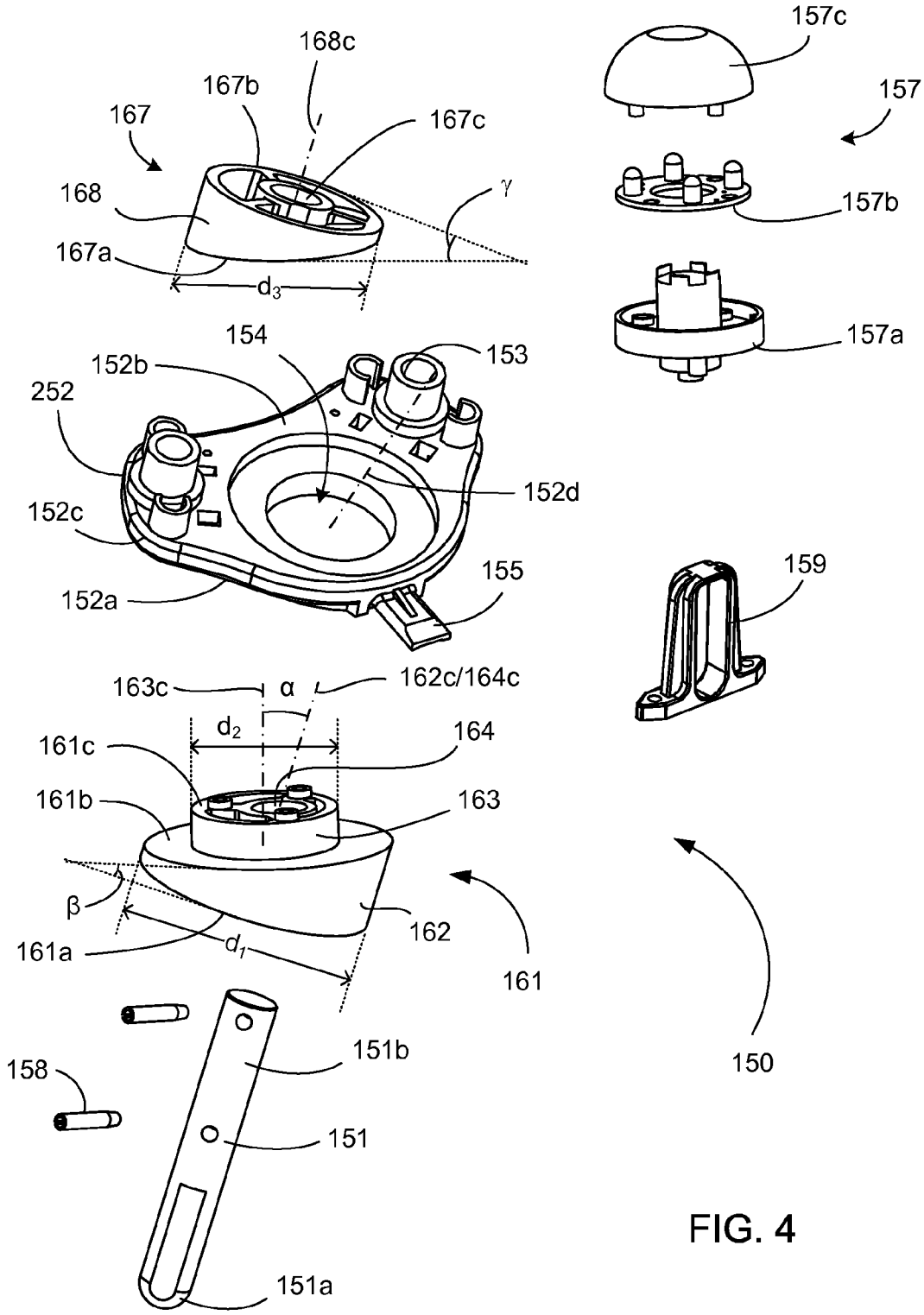
FIG. 4 shows a partially exploded view of a massage member utilized in the massage device as shown in FIG. 1.
Figure 5:
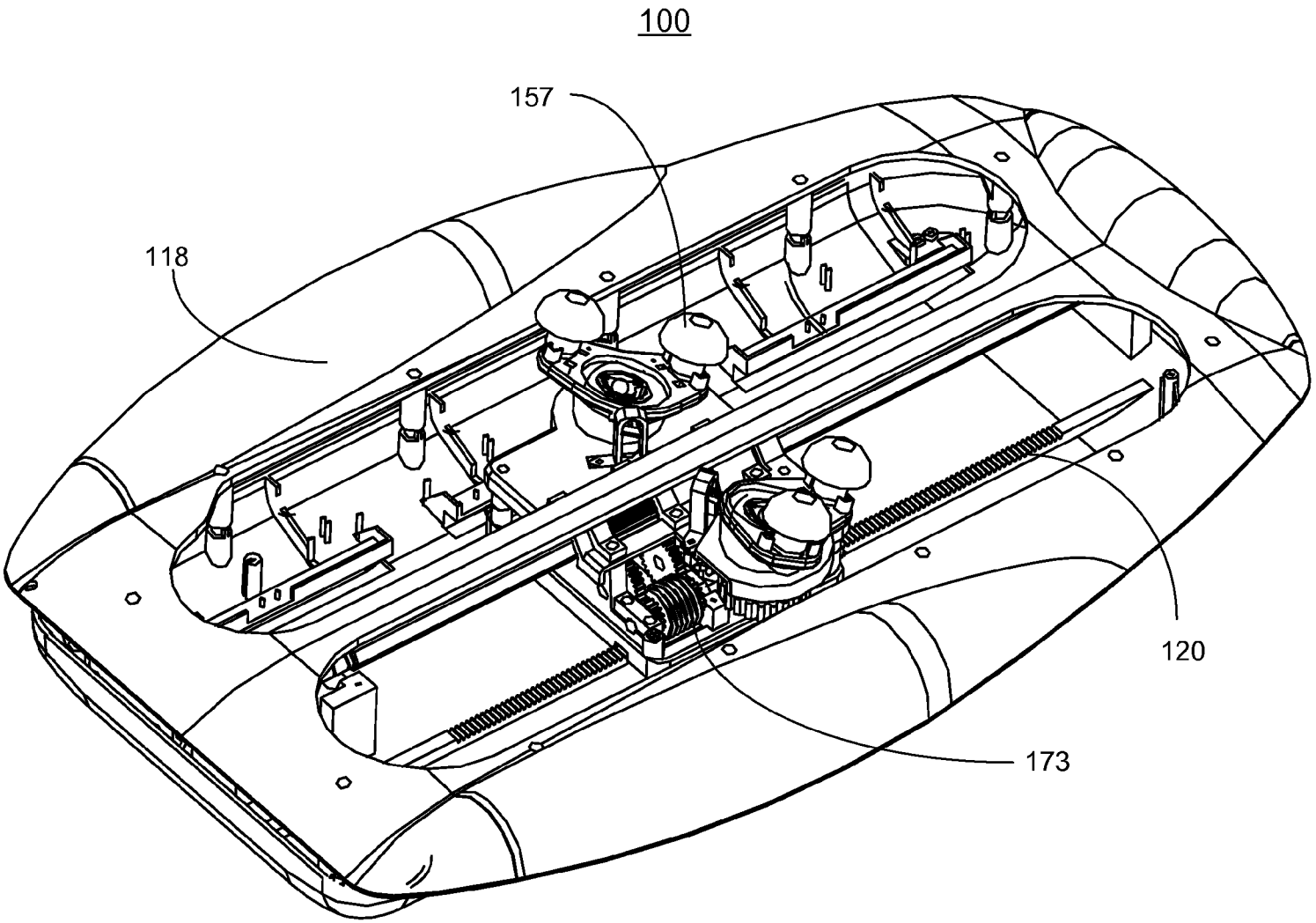
FIG. 5 shows a perspective view of the massage device as shown in FIG. 1.

In this embodiment as shown in FIG. 4, each massage head 157 has a mushroom-shape. Each massage head 157 has a first structure 157*a*, a mushroom-shape node 157*c* and a second structure 157*b* placed between the first structure 157*a* and the mushroom-shape node 157*c*. Each massage head 157 may include an energy source capable of generating thermal energy or photonic energy. The source energy may include a lamp base mounted to the corresponding one of the plurality of stumps 153, a PCB board attached to the lamp base, and heating lamps attached onto the PCB board. For example, the first structure 157*a* and the first structure 157*a* of a massage head 157 can be parts of the source energy.

The driving member 160 has an eccentric wheel 161 and an eccentric block 167. The eccentric wheel 161 has a first planar surface 161*a*, a second planar surface 161*b* tilted to the first planar surface 161*a* at an angle β, a third planar surface 161*c* parallel to the second planar surface 161*b*, a first cylindrical portion 162 defined between the first planar surface 161*a* and the second planar surface 161*b*, a second cylindrical portion 163 defined between the second planar surface 161*b* and the third planar surface 161*c*, and a shaft bore 164 defined through the first cylindrical portion 162 and the second cylindrical portion 163, where the first cylindrical portion 162 has a central axis 162*c* substantially perpendicular to the first planar surface 161*a*, and a diameter, $d_1$, where the second cylindrical portion 163 has a central axis 163*c* substantially perpendicular to the second planar surface 161*b* and defining an angle α, relative to the central axis 162*c* of the first cylindrical portion 162, and a diameter, $d_2$, less than the diameter $d_1$ of the first cylindrical portion 162. Each of the angles α and β is greater than zero but less than 90°, preferably, less than 45°. In one embodiment, β=α. The shaft bore 164 has a central axis 164*c* substantially coincident with the central axis 162*c* of the first cylindrical portion 162.

The eccentric block 167 has a first planar surface 167*a* and a second planar surface 167*b* defining a cylinder body 168 therebetween. the first planar surface 167*a* is tilted to the second planar surface 167*b* at an angle γ. The angle γ is greater than zero but less than 90°, preferably, less than 45°. In one embodiment, γ=α. Again, the angels α, β and γ can also be chosen with other values, same or different. The cylinder body 168 has a central axis 168*c* and a diameter, $d_3$, greater than the diameter $d_2$ of the second cylindrical portion 163 of the eccentric wheel 161. The eccentric block 167 may have a shaft bore 167*c* defined therethrough. The shaft bore 167*c* and the cylinder body 168 are substantially coaxial.

As assembled, the two massage heads 157 are respectively attached to the two stumps 153 of the massage bracket 152. The second cylindrical portion 163 of the eccentric wheel 161 is received in the first opening 154 of the massage bracket 152. The eccentric block 167 is then attached onto the second cylindrical portion 163 of the eccentric wheel 161 such that the first planar surface 167*a* of the eccentric block 167 is substantially in contact with and parallel to the third planar surface 161*c* of the eccentric wheel 161, the central axis 168*c* of the cylinder body 168 of the eccentric block 167 is substantially coincident with the central axis 162*c* of the first cylindrical portion 162 of the eccentric wheel 160, the central axis 152*d* of the massage bracket 152 is substantially coincident with the central axis 163*c* of the second cylinder portion 163 of the eccentric wheel 160, the massage bracket 152 operably cooperates with the second cylindrical portion 163 of the eccentric wheel 161, and the shaft bore 164 of the eccentric wheel 161 and the shaft bore 167*c* of the eccentric block 167 are substantially coaxial. Additionally, the protrusion 155 of the massage bracket 152 is received in the U-shape fixture 159 that in turn, is mounted to the shield member 132 of the carriage 130. The second end portion 151*b* of the gear shaft 151 is then secured into the shaft bore 164 such that when the gear shaft 151 rotates, it drives the driving member 160 to rotate accordingly. Additionally, fastening means such as fastening pins 158 and screws 158*a* may be applied wherever it is needed to secure various components of the massage device 100.

For the massage device 100, in operation, the motor 141 drives the transmission shaft 144 to rotate, which in turn, drives the carriage 130 to move along the plurality of the guiding rails 112 of the base cover 110 and the driving member 160 of the massage assembly 150 to rotate. Since the protrusion 155 of the massage bracket 152 is placed in the U-shape fixture 159 that is mounted to the shield member 134 of the carriage 130, the rotation of the massage bracket 152 around the central axis 162*c* of the first cylindrical portion 162 of the eccentric wheel 160 is prohibited. Therefore, the rotation of the driving member 160 of the massage assembly 150 will drive the massage bracket 152 to gyrate in a way so that its central axis 152*d* rotates around the central axis 162*c* of the first cylindrical portion 162 of the eccentric wheel 160 in the angle α. Such a gyro rotation of the massage bracket 152 causes the two massage heads 157 to move alternatively along a direction parallel to the central axis 162*c* of the first cylindrical portion 162 of the eccentric wheel 160. When the massage heads 157 are applied to parts of the body of a user, a simulated massaging effect is provided.

Figure 6:
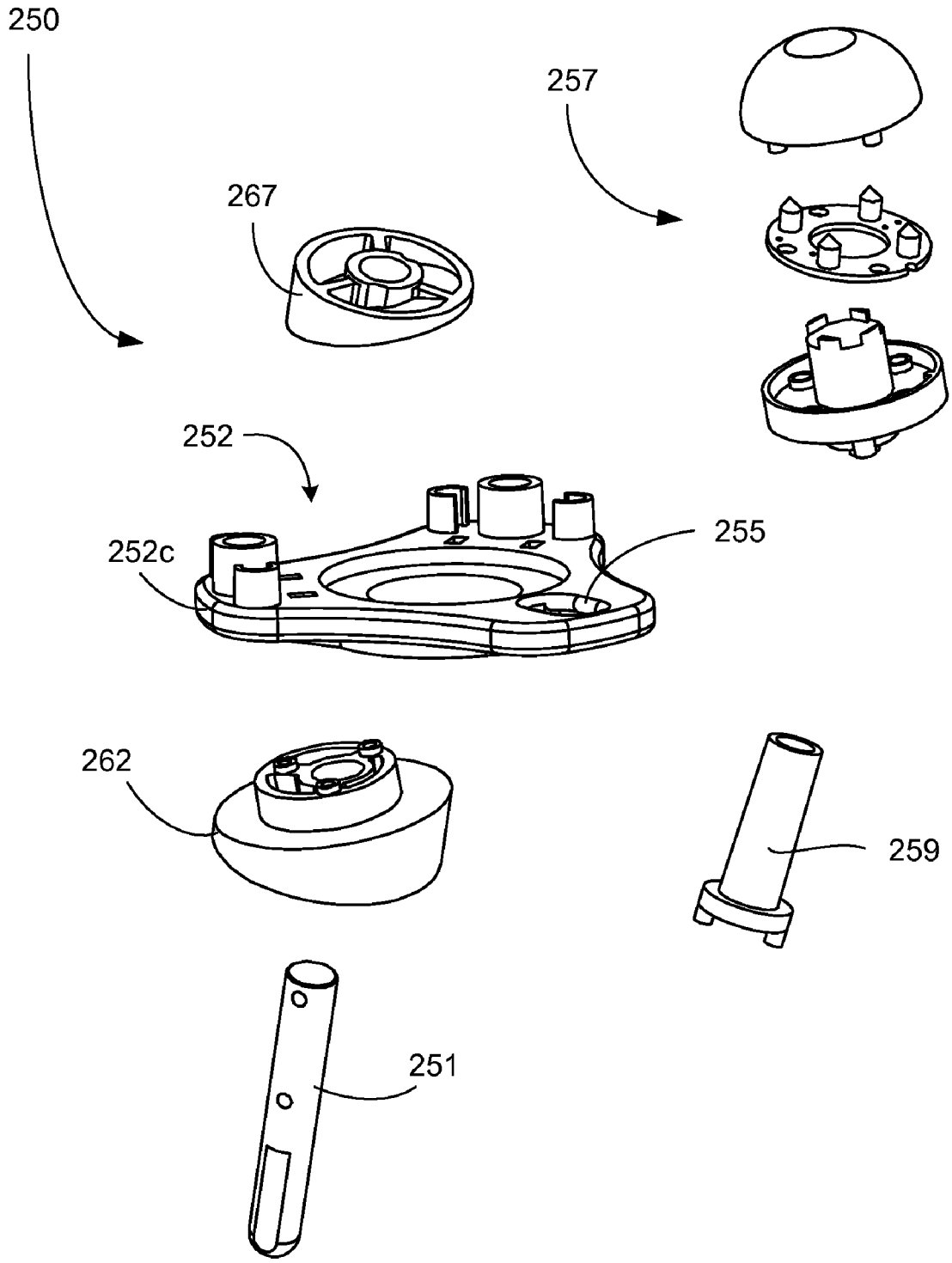
FIG. 6 shows a partially exploded view of a massage member utilized in the massage device according to one embodiment of the present invention.

FIG. 6 shows another embodiment of the massage member 250, which can also be utilized to practice the present invention. The massage member 250 has a gear shaft 251, a driving member 260, a massage bracket 252, two massage heads 257, and a limiting means. In this embodiment, the gear shaft 251, the driving member 260 and the massage heads 257 are identical to these shown in FIGS. 1 and 4. However, the massage bracket 252 has a second opening 255 formed on the edge portion of the bracket body, as shown in FIG. 6, instead of a protrusion extending from the bracket body. Accordingly, the limiting means includes of a fixture bar 259.

For such a massage device using the massage member 250, the arrangement of the transmission assembly and massage assembly is same as that shown in FIG. 1, except that the fixture bar 259 places into the second opening 255 of the massage bracket 252 and is mounted to the shield member of the carriage. Similarly, in operation, the rotation of the driving member of the massage assembly drives the massage bracket to gyrate in a way of which its central axis rotates along the central axis of the first cylindrical portion of the eccentric wheel in the angle α, thereby causing the plurality of massage heads to move alternatively along a direction parallel to the central axis of the first cylindrical portion of the eccentric wheel so as to provide a massage effect to a user.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A massage device, comprising:

(a) a base cover having a longitudinal axis and at least one guiding rail formed parallel to the longitudinal axis;

(b) a rack is formed in the base cover and paralleled to the at least one guiding rail;

(c) a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover;

(d) a transmission assembly received in the chamber and secured in the carriage, having (i) a motor having an output shaft;

(ii) a worm mechanically coupled with the output shaft of the motor;

(iii) a worm wheel meshing with the worm;

(iv) a transmission shaft having a first end portion, an opposite, second end portion, a shaft body defined therebetween, and an axis, wherein the shaft body has a cross-sectional shape of a polygon, and wherein the transmission shaft is mechanically coupled with the worm wheel by the first end portion;

(v) a first lead gear having an exterior surface defining a gear, and an interior surface defining a polygon bore, wherein the polygon bore is adapted for receiving the transmission shaft such that when the polygon bore of the first lead gear receives the transmission shaft, the first lead gear is slidably movable back and forth along the transmission shaft, while not rotatable relative to the transmission shaft around the axis of the transmission shaft;

(vi) a pair of pinion gears meshing with the first lead gear;

(vii) a second lead gear, having a first gear portion meshing with one of the pair of pinion gears, a second gear portion meshing with the other of the pair of pinion gears, and a third gear portion formed therebetween, the third gear portion meshing with the rack;

(viii) a first bevel gear having an exterior surface, an interior surface defining a polygon bore, and a conically gear formed on the exterior surface, wherein the polygon bore is adapted for receiving the transmission shaft such that when the polygon bore of the first bevel gear receives the transmission shaft, the first bevel gear is slidably movable back and forth along the transmission shaft, while not rotatable relative to the transmission shaft around the axis of the transmission shaft;

(ix) a second bevel gear having a conical gear meshing with the conical gear of the first bevel gear and a cylindrical gear extending from the conical gear;

(x) a pair of first gears meshing with the cylindrical gear of the second bevel gear; and (xi) a pair of second gears, each meshing with a corresponding one of the pair of first gears, wherein the pair of second gears is engaged with the massage assembly, wherein when the motor is activated, it drives the worm to rotate, the rotation of the worm results in, in turn, the rotations of the worm wheels, the transmission shaft, the first lead gear, the first bevel gear, the second bevel gear, the pair of first gears and the pair of second gears, wherein the rotation of the first lead gear results in, in turn, the rotation of the pair of pinion gears, and the second lead gear, thereby moving the carriage along the plurality of the guiding rails of the base cover; and (e) a massage assembly having a pair of massage members, each massage member comprising:

(i) a driving member having an eccentric wheel and an eccentric block, wherein the eccentric wheel has a first planar surface, a second planar surface tilted to the first planar surface at an angle β, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, $d_1$, wherein the second cylindrical portion has a central axis substantially perpendicular to the second planar surface and defining an angle $\alpha$, relative to the central axis of the first cylindrical portion, and a diameter, $d_2$, less than the diameter $d_1$ of the first cylindrical portion, and wherein the shaft bore has a central axis that is substantially coincident with the central axis of the first cylindrical portion; and wherein the eccentric block has a first planar surface and a second planar surface defining a cylinder body therebetween, wherein the cylinder body has a central axis and a diameter, $d_3$, greater than the diameter $d_2$ of the second cylindrical portion of the eccentric wheel, and the first planar surface a is tilted to the second planar surface at an angle $\gamma$;

(ii) a massage bracket having a first surface and an opposite, second surface defining a bracket body therebetween, a central axis and a plurality of stumps spaced-apart on the first surface, wherein the bracket body defines a first opening in the central region; and (iii) a plurality of massage heads, wherein as assembled, the plurality of massage heads is attached to the plurality of stumps of the massage bracket, respectively, the second cylindrical portion of the eccentric wheel is received in the first opening of the massage bracket, the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel and the central axis of the massage bracket is substantially coincident with the central axis of the second cylinder portion of the eccentric wheel, and the massage bracket operably cooperates with the second cylindrical portion of the eccentric wheel.

2. The massage device of claim 1, wherein each massage member further comprises a gear shaft having a first end portion and an opposite, second end portion, wherein the gear shaft extends through the shield member of the carriage and is coaxially mounted to the corresponding second gear by the first end portion, while received in the shaft bore of the eccentric wheel by the second end portion.

3. The massage device of claim 2, wherein each massage member further comprises means for limiting the massage bracket from rotating along the central axis of the first cylindrical portion of the eccentric wheel.

4. The massage device of claim 3, wherein the limiting means comprises a U-shape fixture or a fixture bar mounted to the shield member of the carriage.

5. The massage device of claim 4, wherein in operation, the motor drives the transmission shaft to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user.

6. The massage device of claim 1, wherein each of the angles $\alpha$, $\beta$ and $\gamma$ is greater than zero but less than 90°, preferably, greater than zero but less than 45°.

7. The massage device of claim 6, wherein $\beta=\alpha$, and $\gamma=\alpha$.

8. The massage device of claim 1, wherein each of the plurality of massage heads has a mushroom-shape.

9. The massage device of claim 8, wherein each of the plurality of massage heads comprises a first structure, a mushroom-shape node and a second structure placed between the first structure and the mushroom-shape node.

10. The massage device of claim 1, wherein each of the plurality of massage heads comprises an energy source of capable of generating at least one of thermal energy and photonic energy.

11. The massage device of claim 10, wherein the source energy comprises a lamp base mounted to the corresponding one of the plurality of stumps, a PCB board attached to the lamp base, and heating lamps attached onto the PCB board.

12. A massage device, comprising:

(a) a transmission assembly having:

(i) a motor having an output shaft;

(ii) a worm mechanically coupled with the output shaft of the motor;

(iii) a worm wheel meshing with the worm;

(iv) a transmission shaft having a first end portion, an opposite, second end portion, a shaft body defined therebetween, and an axis, wherein the shaft body has a cross-sectional shape of a polygon, and wherein the transmission shaft is mechanically coupled with the worm wheel by the first end portion;

(v) a first lead gear having an exterior surface defining a gear, and an interior surface defining a polygon bore, wherein the polygon bore is adapted for receiving the transmission shaft such that when the polygon bore of the first lead gear receives the transmission shaft, the first lead gear is slidably movable back and forth along the transmission shaft, while not rotatable relative to the transmission shaft around the axis of the transmission shaft;

(vi) a pair of pinion gears meshing with the first lead gear;

(vii) a second lead gear, having a first gear portion meshing with one of the pair of pinion gears, a second gear portion meshing with the other of the pair of pinion gears, and a third gear portion formed therebetween;

(viii) a first bevel gear having an exterior surface, an interior surface defining a polygon bore, and a conically gear formed on the exterior surface, wherein the polygon bore is adapted for receiving the transmission shaft such that when the polygon bore of the first bevel gear receives the transmission shaft, the first bevel gear is slidably movable back and forth along the transmission shaft, while not rotatable relative to the transmission shaft around the axis of the transmission shaft;

(ix) a second bevel gear having a conical gear meshing with the conical gear of the first bevel gear and a cylindrical gear extending from the conical gear;

(x) a pair of first gears meshing with the cylindrical gear of the second bevel gear; and (xi) a pair of second gears, each meshing with a corresponding one of the pair of first gears, wherein the pair of second gears is engaged with the massage assembly, wherein when the motor is activated, it drives the worm to rotate, the rotation of the worm results in, in turn, the rotations of the worm wheels, the transmission shaft, the first lead gear, the first bevel gear, the second bevel gear, the pair of first gears and the pair of second gears, wherein the rotation of the first lead gear results in, in turn, the rotation of the pair of pinion gears, and the second lead gear; and (b) a massage assembly having a plurality of massage heads, engaged with the transmission assembly such that the rotation of the pair of second gears drives the plurality of massage heads to move in a predefined way so as to provide massage effects, while the rotation of the second lead gear drives the massage assembly to move along a direction parallel to the transmission shaft.

13. The massage device of claim 12, further comprising:

(a) a base cover having a longitudinal axis and at least one guiding rail formed parallel to the longitudinal axis;

(b) a rack in formed in the base cover and paralleled to the at least one guiding rail; and (c) a carriage for receiving and securing the transmission assembly therein, having a chassis member and a shield member placed over the chassis member to form a chamber therebetween, wherein the chassis member has a plurality of grooves formed such that when the carriage is engaged with the base cover, the at least one guiding rail is received in the plurality of grooves of the chassis member and the carriage is longitudinally movable back and forth along the plurality of guiding rails of the base cover.

14. The massage device of claim 13, wherein the massage assembly having a pair of massage members, each massage member comprising:

(i) a driving member having an eccentric wheel and an eccentric block, wherein the eccentric wheel has a first planar surface, a second planar surface tilted to the first planar surface at an angle $\beta$, a third planar surface parallel to the second planar surface, a first cylindrical portion defined between the first planar surface and the second planar surface, a second cylindrical portion defined between the second planar surface and the third planar surface, and a shaft bore defined through the first cylindrical portion and the second cylindrical portion, wherein the first cylindrical portion has a central axis substantially perpendicular to the first planar surface, and a diameter, d1, wherein the second cylindrical portion has a central axis substantially perpendicular to the second planar surface and defining an angle $\alpha$ relative to the central axis of the first cylindrical portion, and a diameter, d2, less than the diameter d1 of the first cylindrical portion, and wherein the shaft bore has a central axis that is substantially coincident with the central axis of the first cylindrical portion; and wherein the eccentric block has a first planar surface and a second planar surface defining a cylinder body therebetween, wherein the cylinder body has a central axis and a diameter, d3, greater than the diameter d2 of the second cylindrical portion of the eccentric wheel, and the first planar surface is tilted to the second planar surface at an angle $\gamma$; and (ii) a massage bracket having a first surface and an opposite, second surface defining a bracket body therebetween, a central axis and a plurality of stumps spaced-apart on the first surface, wherein the bracket body defines an opening therethrough in the central region, wherein as assembled, the plurality of massage heads is attached to the plurality of stumps of the massage bracket, respectively, the second cylindrical portion of the eccentric wheel is received in the opening of the massage bracket; the eccentric block is mounted to the second cylindrical portion of the eccentric wheel such that the first planar surface of the eccentric block is substantially in contact with and parallel to the third planar surface of the eccentric wheel, the central axis of the cylinder body of the eccentric block is substantially coincident with the central axis of the first cylindrical portion of the eccentric wheel, the central axis of the massage bracket is substantially coincident with the central axis of the second cylinder portion of the eccentric wheel, and the massage bracket operably cooperates with the second cylindrical portion of the eccentric wheel.

15. The massage device of claim 14, wherein each massage member further comprises a gear shaft having a first end portion and an opposite, second end portion, wherein the gear shaft extends through the shield member of the carriage and is coaxially mounted to the corresponding second gear of the transmission assembly by the first end portion, while received in the shaft bore of the eccentric wheel by the second end portion.

16. The massage device of claim 15, wherein each massage member further comprises means for limiting the massage bracket from rotating along the central axis of the first cylindrical portion of the eccentric wheel.

17. The massage device of claim 16, wherein the limiting means comprises a U-shape fixture or a fixture bar mounted to the shield member of the carriage.

18. The massage device of claim 17, wherein in operation, the motor drives the transmission shaft to rotate, which in turn, drives the carriage to move along the plurality of the guiding rails of the base cover and the driving member of the massage assembly to rotate, the rotation of the driving member of the massage assembly drives the massage bracket to gyrate in a way of which its central axis rotates along the central axis of the first cylindrical portion of the eccentric wheel in the angle $\alpha$, thereby causing the plurality of massage heads to move alternatively along a direction parallel to the central axis of the first cylindrical portion of the eccentric wheel so as to provide a massage effect to a user.

19. A transmission assembly usable for a massage device, comprising:

(a) a motor having an output shaft;

(b) a worm mechanically coupled with the output shaft of the motor;

(c) a worm wheel meshing with the worm;

(d) a transmission shaft having a first end portion, an opposite, second end portion, a shaft body defined therebetween, and an axis, wherein the shaft body has a cross-sectional shape of a polygon, and wherein the transmission shaft is mechanically coupled with the worm wheel by the first end portion;

(e) a first lead gear having an exterior surface defining a gear, and an interior surface defining a polygon bore, wherein the polygon bore is adapted for receiving the transmission shaft such that when the polygon bore of the first lead gear receives the transmission shaft, the first lead gear is slidably movable back and forth along the transmission shaft, while not rotatable relative to the transmission shaft around the axis of the transmission shaft;

(f) a pair of pinion gears meshing with the first lead gear;

(g) a second lead gear, having a first gear portion meshing with one of the pair of pinion gears, a second gear portion meshing with the other of the pair of pinion gears, and a third gear portion formed therebetween;

(h) a first bevel gear having an exterior surface, an interior surface defining a polygon bore, and a conically gear formed on the exterior surface, wherein the polygon bore is adapted for receiving the transmission shaft such that when the polygon bore of the first bevel gear receives the transmission shaft, the first bevel gear is slidably movable back and forth along the transmission shaft, while not rotatable relative to the transmission shaft around the axis of the transmission shaft;

(i) a second bevel gear having a conical gear meshing with the conical gear of the first bevel gear and a cylindrical gear extending from the conical gear;

(j) a pair of first gears meshing with the cylindrical gear of the second bevel gear; and (k) a pair of second gears, each meshing with a corresponding one of the pair of first gears, wherein the pair of second gears is engaged with the massage assembly, wherein when the motor is activated, it drives the worm to rotate, the rotation of the worm results in, in turn, the rotations of the worm wheels, the transmission shaft, the first lead gear, the first bevel gear, the second bevel gear, the pair of first gears and the pair of second gears, wherein the rotation of the first lead gear results in, in turn, the rotation of the pair of pinion gears, and the second lead gear.

* * * * *